US008333585B2

(12) United States Patent
Theresa et al.

(10) Patent No.: US 8,333,585 B2
(45) Date of Patent: Dec. 18, 2012

(54) INTER-LOCKING CANDLE JAR SET

(75) Inventors: Dominick Theresa, Edison, NJ (US); Michele Kramer, South Amboy, NJ (US); Nicholas Theresa, Bridgewater, NJ (US)

(73) Assignee: Dominick Theresa, Edison, NJ (US)

( * ) Notice: Subject to any disclaimer, the term of this patent is extended or adjusted under 35 U.S.C. 154(b) by 596 days.

(21) Appl. No.: 12/503,069

(22) Filed: Jul. 14, 2009

(65) Prior Publication Data

US 2011/0014580 A1 Jan. 20, 2011

(51) Int. Cl.
*F23D 3/16* (2006.01)

(52) U.S. Cl. ..... 431/291; 431/288; 431/126; 431/289; 431/294; 431/296; 215/10; 215/227

(58) Field of Classification Search ..... 431/291, 431/288, 126, 289, 294, 296, 295, 292; 215/10, 215/227

See application file for complete search history.

(56) References Cited

U.S. PATENT DOCUMENTS

| | | | | | |
|---|---|---|---|---|---|
| 2,218,901 | A * | 10/1940 | Addis et al. | ..... | 206/443 |
| 3,115,245 | A * | 12/1963 | Schechter | ..... | 220/279 |
| 4,390,104 | A * | 6/1983 | Cummings | ..... | 215/232 |
| 6,120,283 | A * | 9/2000 | Cousins | ..... | 431/289 |
| D433,168 | S * | 10/2000 | Cousins | ..... | D26/9 |
| 6,554,448 | B2 * | 4/2003 | Carpenter et al. | ..... | 362/161 |
| 7,614,876 | B1 * | 11/2009 | Ward-Kubik | ..... | 431/289 |
| 2002/0185410 | A1 * | 12/2002 | Travis-Pence | ..... | 206/736 |
| 2004/0016761 | A1 * | 1/2004 | Wilde et al. | ..... | 220/630 |
| 2009/0170046 | A1 * | 7/2009 | Wooten | ..... | 431/289 |

* cited by examiner

*Primary Examiner* — Steven B McAllister
*Assistant Examiner* — Avinash Savani

(57) ABSTRACT

A glass pear shape candle jar that has inter-locking top and bottom candle pieces that collectively it forms a 4-in-1 candle set. This multi-purpose inter-locking candle jar set, has four difference types of candles. This inter-locking candle jar set is a 4-in-1 set comprising of: The use of a main full size candle jar, an upright flat dome top candle, a dinner candle holder within the flat dome and a tea light candle base and holder.

12 Claims, 3 Drawing Sheets

INTER-LOCKING CANDLE JAR SET

CLAIM OF NONPROVISIONAL

This application's claim of nonprovisional may stand on its own for the present invention. This claim was originally to be related to a recent provisional application No. 61/043,130 filed on Jul. 10, 2008.

FIELD OF THE INVENTION

The present invention relates generally to candle jars with or without any type lids, covers, domes or caps.

BACKGROUND OF INVENTION

This invention relates to the traditional single burning type candle jars with or without any type lids, covers, domes or caps.

This improved method of inter-locking candle pieces is a multi-purpose candle set.

This invention allows consumer preference to use and burn any of the four different types of candles and holders from this inter-locking candle jar set.

SUMMARY OF THE INVENTION

A multi-purpose, inter-locking candle jar set, which gives the consumer a candle jar, along with removable pieces, that gives a variety of choice to either light one piece of the set at a time or several of the pieces at the same time.

The main candle jar has a top and bottom, which is removable from itself and the two removable pieces may contain the same color and wax, that is within the embodiment of the main candle jar.

The top of the main candle jar, the removable flat dome lid, not only contains candle wax on the inside of it which can be burned, but on the outside of the top flat dome surface is also a hole in which a dinner type candle may be included in the candle box set, can be inserted into, which can then be burned when the top flat dome lid is sitting upright, either on or off the main candle jar.

The bottom piece can also be removed from the main candle jar, which allows the main candle jar to stand and be burned on its own.

The removable bottom base piece contains a tea light holder and tea light candle which, when removed from the main candle jar, can be lit as the candle sits in the holder which is part of the tea light base.

The main candle jar embodiment wax, the wax inside the top candle dome, the dinner candle and the tea light wax may be made up of a same, particular color and/or scent.

A label is placed on the outside of the main candle jar which provides the name and the particular scent of the inter-locking candle jar set.

DETAILED DESCRIPTION OF THE INVENTION

Figure 1:
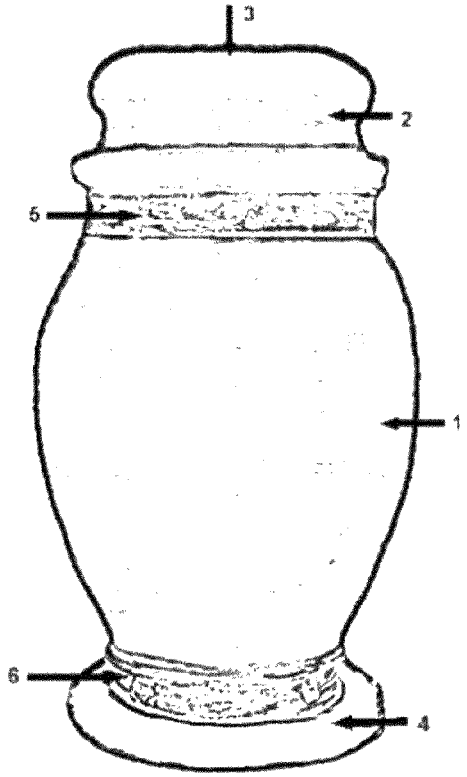
FIG. 1 is a semi-diagrammatic view of the inter-locking candle jar set.

In the embodiments of the inter-locking candle jar set FIG. 1 has different inter-locking candle pieces 2 and 4 which uniquely combines and inter-locks plastic rim 5 and 6 into the main candle jar 1 as shown in FIG. 1.

This multi-purpose inter-locking candle jar set FIG. 1 gives the consumer a candle jar, along with removable pieces 2 and 4, FIG. 1 that gives a variety of ways to either light to burn 1, 2, 3 and 4 of FIG. 1 of the inter-locking candle jar set and burn just one piece at a time or burn several of the pieces at the same time.

Figure 2:
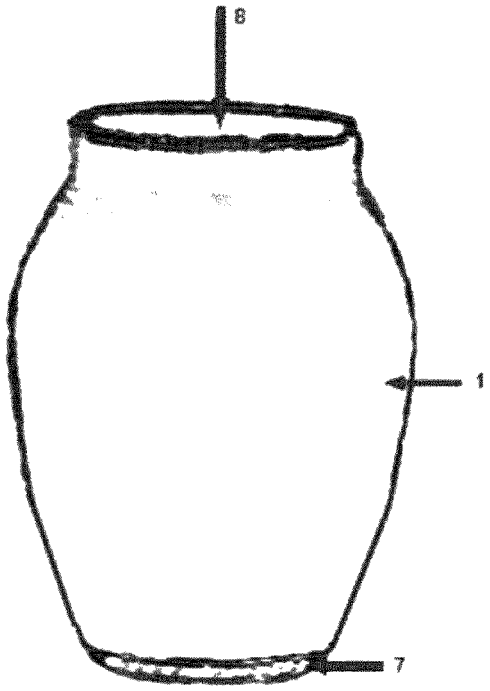
FIG. 2 is a pear shaped clear glass main candle jar.
Figure 3:
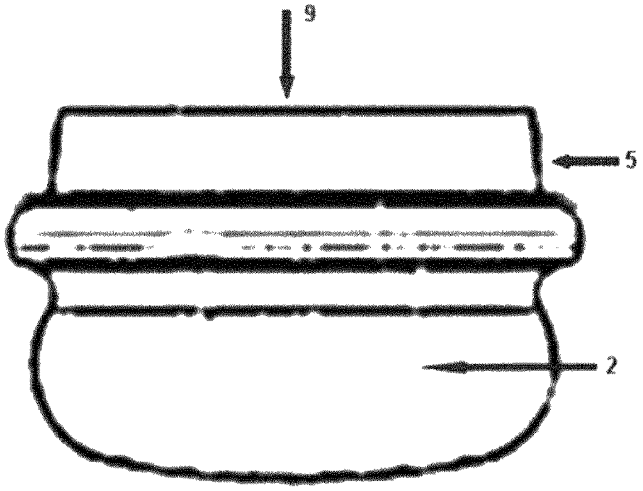
FIG. 3 is a side view of a glass upright flat dome top candle.

In FIG. 2 the pear shaped clear glass main candle jar 1 has a removable flat dome top candle lid 2, FIG. 1 which 2 is also a top candle and is up-righted for burning FIG. 3. In the top of the flat dome FIG. 5 is a hole 3 which is a holder for dinner candle. The main candle jar 1 has a removable bottom 6, FIG. 1 that 6 is attached to 4 the tea light base which 4 also acts as a tea light holder 10 for a tea light candle FIG. 4. A tea light candle would sit within the middle of 10, FIG. 4 and can be burned if the removable bottom 6 is removed from main candle jar 1 as the tea light base and holder 4 will sit along FIG. 4 for burning of a tea light candle.

FIG. 1 is the main candle jar which has all its set pieces inter-locked on it. It is a clear glass pear shaped jar 1. The main candle jar 1 is filled with a particular color of wax 8, FIG. 2. The bottom 7 in FIG. 2 of the main candle jar 1 is indented ¼ of an inch 7, as the jar sits on the rim FIG. 2. FIG. 1 shows all the main candle set pieces 1, 2, 4 all attached—which contains the removable top band 5 and bottom band 6. The main candle jar 1, FIG. 1 could contain a color picture label which is placed on the front of the main candle jar 1, giving the name and/or scent of the candle.

FIG. 2 shows the main candle jar 1 without the removable top 5 and bottom 6 pieces attached to it. Inside the main candle jar 1 is the embodiment of wax 8, FIG. 2 which contains a particular color and scent. This main candle jar 1 has a wick on top of the embodiment wax 8, FIG. 2 which can be safely lit.

FIG. 3 is the removable flat dome top candle 2 which has a hollow inside in which wax is poured in 9 as this flat dome top candle 2 turns into a candle of its own. The top candle 2 would rest upside down FIG. 3 on its dome flat surface which safely lay flat so that the wax, which contains a wick on top 9 can safely burn. This top candle 2 is a large, clear glass flat dome lid with rounded edges FIG. 3. The top of the dome has a flat surface FIG. 3. The open space 9 of this top candle 2 is filled with a particular color and/or scent, which may match the wax in the main candle jar 1. A peel-away cover is attached over the wax-filled section 9 and attached to a removable plastic rim 5 as the plastic rim is attached to the glass rim 2 of the top candle. The cover/plastic rim 5 is removed before candle is burned. This top candle 2 is burned by it sitting on the large flat dome lid FIG. 3 which is turned upside down, on its flat surface FIG. 3.

Figure 4:
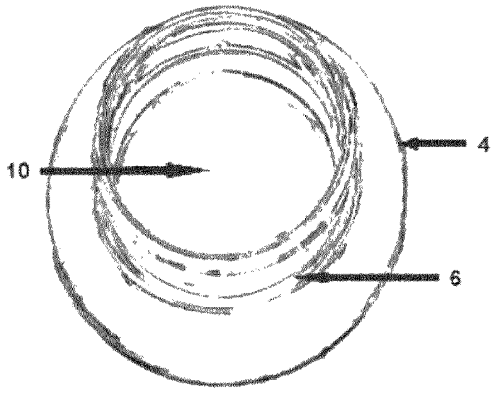
FIG. 4 is a similar straight on view of a glass tea light base and the tea light center holder.
Figure 5:
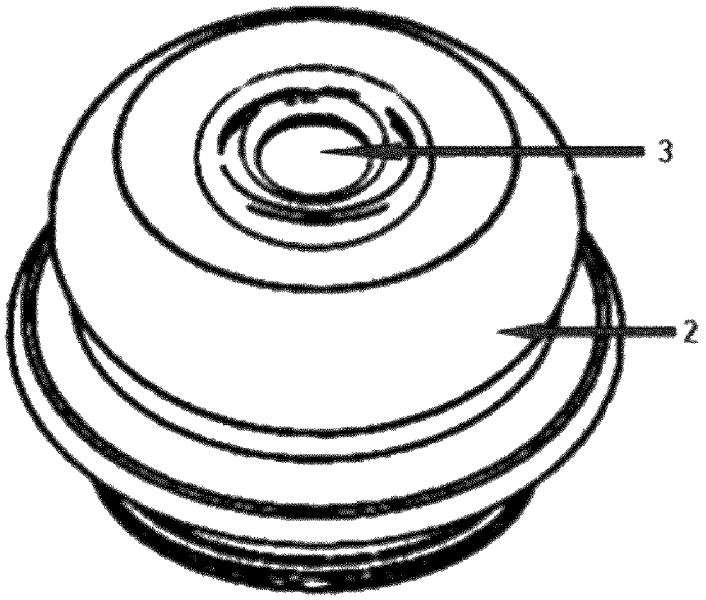
FIG. 5 is an angle view of the dinner candle holder within the flat dome.

FIG. 4 is the removable bottom piece 6 that the main candle jar 1 initially sits on FIG. 1. The bottom plastic rim piece 6 is removed from the main candle jar 1 and sits on its own FIG. 4 as it has a flat surface. Inside the bottom piece which is a tea light base 4 for a tea light candle in holder 10, FIG. 4. This holder 10 can retain the tea light candle therein. The tea light candle can be safely burned sitting inside the holder 10, FIG. 4. The tea light base 4 and holder 10 is a large, clear glass, flat bottom with rounded edges. The opposite side of the flat bottom has a ¾ inch deep hole 10 and acts as a tea light holder 10, in order to hold a tea light candle. A peel-away cover attached to a plastic rim 6 as the plastic rim is attached to 2 the glass rim of the tea light. The cover/plastic rim 6 is placed over the open tea light holder 10 in order to hold the tea light therein. The cover/plastic rim is removed upon burning the tea light candle in tea light holder 10.

FIG. 5 is the removable flat dome which contains the hollow hole 3, which can used for a dinner candle to sit and burn safely in FIG. 5. The top hollow hole 3 is on a flat dome top surface FIG. 1. The dinner candle holder 3 is on the top of the large flat dome FIG. 5 within its flat surface, is a hole 3 in the middle of the flat dome, which measures ¾ of an inch deep FIG. 5. This hole 3 will a hold dinner candle and of a particular color and/or scent. A small peel-away cover is placed over the hole 3 and is removed before inserting the dinner candle FIG. 5.

What is claimed is:

1. An illumination system, comprising:

a jar-type candle including an outer container defining an exterior surface and having a cylindrical outer wall defining an interior and a lower wall closing one end thereof, the cylindrical outer wall defining a rim around an open end opposite the base, the jar-type candle further including a conformal wax mass within the interior of the outer container supporting a wick exposed on the wax mass toward the open end of the container, wherein the conformal wax mass substantially follows a shape of a portion of the interior and is retained therein;

a lid including a body defining a primary cavity and a cylindrical portion adjacent to the primary cavity and configured to be removably securable over the open end of the container of the jar-type candle, the body further defining a generally flat portion thereof opposite the cylindrical portion and a secondary cavity open to and surrounded by the substantially flat portion, the lid further including a conformal wax mass within the primary cavity of the body supporting a wick exposed on the wax mass toward the open end of the container, wherein the conformal wax mass substantially follows a shape of a portion of the primary cavity and is retained therein, wherein the lid further includes a cover removably affixed over the secondary cavity, the cover including a tab extending therefrom that is unaffixed with the lid; and a base defining a cylindrical portion disposed on a first side of the base and configured to be removably securable on a portion of the exterior surface of the container of the jar-type candle, the base further defining a cavity therein disposed on the first side of the base and surrounded by the cylindrical portion, the base includes a tea light-type candle received within the cavity thereof and includes a removable cover adhered to the cylindrical portion thereof to enclose the tea light-type candle within the cavity.

2. The system of claim 1, wherein the lower wall of the outer container of the jar-type candle defines a generally flat bottom surface of the outer container.

3. The system of claim 1, wherein the exterior surface of outer container of the jar-type candle includes indentation feature therein adjacent the lower wall, and wherein the base is configured to engage with that with the indentation feature to facilitate removable engagement of the base onto the jar-type candle.

4. The system of claim 3, wherein the base further includes a resiliently deformable ring connected with the cylindrical portion, and wherein the base is configured to engage with the indentation feature of the jar-type candle by a fit of the resiliently deformable ring over a portion of the outer container and into the indention feature.

5. The system of claim 1, wherein the second side of the base includes a substantially flat portion such that the base is configured to rest on a surface with the jar-type candle supported above the surface by the base.

6. The system of claim 1, wherein the lid includes a resiliently deformable ring connected with the cylindrical portion thereof, and wherein the lid is configured to mate with the open end of the jar-type candle by a press-fit of the resiliently deformable ring into the open end.

7. The system of claim 1, wherein the lid is configured to rest on a surface with the substantially flat portion in contact therewith such that the cylindrical portion faces away from the surface.

8. The system of claim 7, wherein the lid is further configured to rest on a surface with a rim of the cylindrical portion in contact therewith such that the secondary cavity is disposed away from the surface in a position to receive a candle therein.

9. The system of claim 1, wherein the secondary cavity of the lid includes at least one ridge therein separating the secondary cavity into at least two portions of the cavity having different diameters.

10. The system of claim 9, wherein the ridges are configured such that the secondary cavity can receive and retain various forms of candles therein.

11. The system of claim 1, wherein at least one of the jar-type candle, the lid, and the base has a label applied thereto.

12. The system of claim 1, wherein the lid further includes a cover removably affixed over the primary cavity, the cover including a tab extending therefrom that is unaffixed with the lid.

* * * * *